US006152758A

United States Patent [19]

Matsuoka

[11] Patent Number: 6,152,758

[45] Date of Patent: Nov. 28, 2000

[54] SELF-TIGHTENING ELECTRICAL CONNECTION UNIT

[75] Inventor: Hideo Matsuoka, Yokkaichi, Japan

[73] Assignee: Sumitomo Wiring Systems, Ltd., Japan

[21] Appl. No.: 09/199,861

[22] Filed: Nov. 25, 1998

[30] Foreign Application Priority Data

| | | | |
|---|---|---|---|
| Nov. 25, 1997 | [JP] | Japan | 9-323157 |
| Nov. 25, 1997 | [JP] | Japan | 9-323158 |
| Nov. 25, 1997 | [JP] | Japan | 9-323159 |

[51] Int. Cl.[7] ..... H01R 13/627

[52] U.S. Cl. ..... 439/364; 439/34; 439/76.2; 439/374; 439/701; 439/247

[58] Field of Search ..... 439/76.2, 364, 439/701, 374, 378, 246, 247, 34

[56] References Cited

U.S. PATENT DOCUMENTS

| | | | |
|---|---|---|---|
| 4,812,133 | 3/1989 | Fleak et al. . | |
| 5,000,693 | 3/1991 | Hatagishi et al. . | |
| 5,217,386 | 6/1993 | Ohsumi et al. | 439/364 |
| 5,312,268 | 5/1994 | Sumida | 439/364 |
| 5,378,173 | 1/1995 | Hashizawa | 439/701 |
| 5,480,322 | 1/1996 | Ishii et al. | 439/378 |
| 5,545,053 | 8/1996 | Ishii et al. | 439/364 |
| 5,577,934 | 11/1996 | Yagi et al. | 439/540.1 |

FOREIGN PATENT DOCUMENTS

| | | |
|---|---|---|
| 0779680 | 6/1997 | European Pat. Off. . |
| 4228531 | 4/1993 | Germany . |
| 472819 | 4/1992 | Japan . |
| 2141594 | 12/1984 | United Kingdom . |

*Primary Examiner*—Paula Bradley
*Assistant Examiner*—Truc Nguyen
*Attorney, Agent, or Firm*—Bierman, Muserlian and Lucas

[57] ABSTRACT

An electrical connection unit which includes a main box, a connector mounted from one side of the main box, and a junction block mounted in the main box from the opposite side. The junction block carries electrical parts such as relays, fuses, etc. There is a connector cavity in the main box into which the connector is placed. There is also a support in the connector cavity upon which the connector rests in its preliminary position. Tightening elements on the junction block and the connector serve to affix these two elements together in their assembled position. There are also cavity grooves on the inner surface of the connector cavity and complementary projections which enter the grooves as the elements are assembled. The Invention provides a means whereby the connection unit can be readily assembled without the necessity of turning it over and without the use of any tools. The tightening means are simple and easy to operate, thus minimizing the cost of the finished product.

4 Claims, 5 Drawing Sheets

SELF-TIGHTENING ELECTRICAL CONNECTION UNIT

This Application claims the benefit of the priority of Japanese 9-323157; 9-323158; and 9-323159, all filed Nov. 25, 1997.

The present Invention is directed to an electrical connection unit which contains a junction block and is primarily intended for mounting in the engine compartment of a vehicle to provide power to various electrical elements contained therein or used therewith.

BACKGROUND OF THE INVENTION

In a conventional electrical connection unit of this type, a connector cavity is formed on a lower portion of the junction box, on which are mounted electrical parts such as relays and/or fuses. A connector from which a wire harness is extended is directly assembled and inserted into the connector cavity. In the unit, a nut is fixed to the junction block and a bolt opening is formed on the connector. A fastening bolt is passed through the bolt opening from below the connector and is screwed to the nut, thus tightening and fixing the junction block and the connector to each other. In this assembled state, the wire harness is extended in a restricted manner in a prescribed direction.

Alternatively, the junction block can be connected to the connector by having it mounted inside the unit and having the connector installed therein. In these units, the connection of the junction block and the connector requires proper centering at prescribed positions of the junction block and the connector relative to each other. Thus, a centering adjuster containing a spring is disposed on the connector cavity of the junction block or the main unit. The pressure from this spring centers the connector when the connector is connected to the junction block. However, the use of the centering spring to properly locate the junction block and the connector results in a complex structure and increased production costs.

BRIEF DESCRIPTION OF THE INVENTION

To solve the foregoing problems, there is provided an electrical connection unit comprising a main box, a connector mounted in the main box, and a junction block carrying electrical parts. The connector is introduced into the main box from a first side and the junction block is inserted from a second side which is opposite the first side.

There is a connector cavity in the main box into which the connector is placed. There is a support in the connector cavity which extends inwardly from the inner wall thereof. The connector rests loosely on the support in a preliminary position when the connector is being mounted. There are tightening elements on the junction block and the connection whereby, after the main box is mounted on a substrate, the elements are actuated and draw the junction block and the connection block together. In this position, they are fixed to each other and the connector is in its assembled position.

It is desirable to have a plurality of cavity grooves on the inner surface of the connection cavity and a plurality of projections complementary thereto on the junction block. The projections enter the cavity groove as the connection unit is brought into its assembly position. The combination of grooves and projections guides the junction unit and centers the connector in the connector cavity. It is also possible to reverse the arrangement and have the cavity grooves on the junction block and the projections on or in the connector cavity.

To secure the portions of the connection unit together, it is advantageous to have a fastening bolt on either the connector or the junction box and a nut retained on the other. Thus, tightening the bolt draws the junction box and connector together into their assembled position.

In assembling the connection unit of the present Invention, the connector is inserted into the connector cavity and is temporarily loosely supported therein. The wire harness, which is attached to the connector, is led out of the junction box in its predetermined direction and the unit is in its preliminary position. In this position, the main box is mounted on the substrate.

Thereafter, the junction box is inserted into the main box from the second side. Then, the connector, in the connector cavity, and the junction block are tightened into engagement with each other (the assembled position). The junction box carries electrical parts such as relays, fuses, and the like.

It has been found useful to provide locating elements on the connector and the junction box. In this way, the connector is guided into proper position as it is moved from the preliminary position to the assembled position. This can be readily accomplished by providing a tapered surface on either the connector or the junction block and a complementary slanted surface on the other.

The support is advantageously one or more claws which project inwardly from the inner wall of the connector cavity. The connector then rests on the claw when in the preliminary position. However, once the unit is fully assembled, the connector is drawn toward the junction box and is raised off the claws.

As tightening elements, the combination of a nut fixed to the connector, a bolt opening in the junction block, and a fastening bolt passing therethrough and engaging the nut is particularly useful. It is only necessary to turn the bolt in order to tighten the connector and junction block into the assembled position. In particular, there is an engagement element on the junction box and a retainer on the connector. These are complementary to each other and provide added security in locating the parts of the unit properly. Of course, the locations of the engagement element and retainer can be reversed.

BRIEF DESCRIPTION OF THE DRAWINGS

In the accompanying drawings, constituting a part hereof, and in which like reference characters indicate like parts.

DETAILED DESCRIPTION OF THE INVENTION

Figure 2:
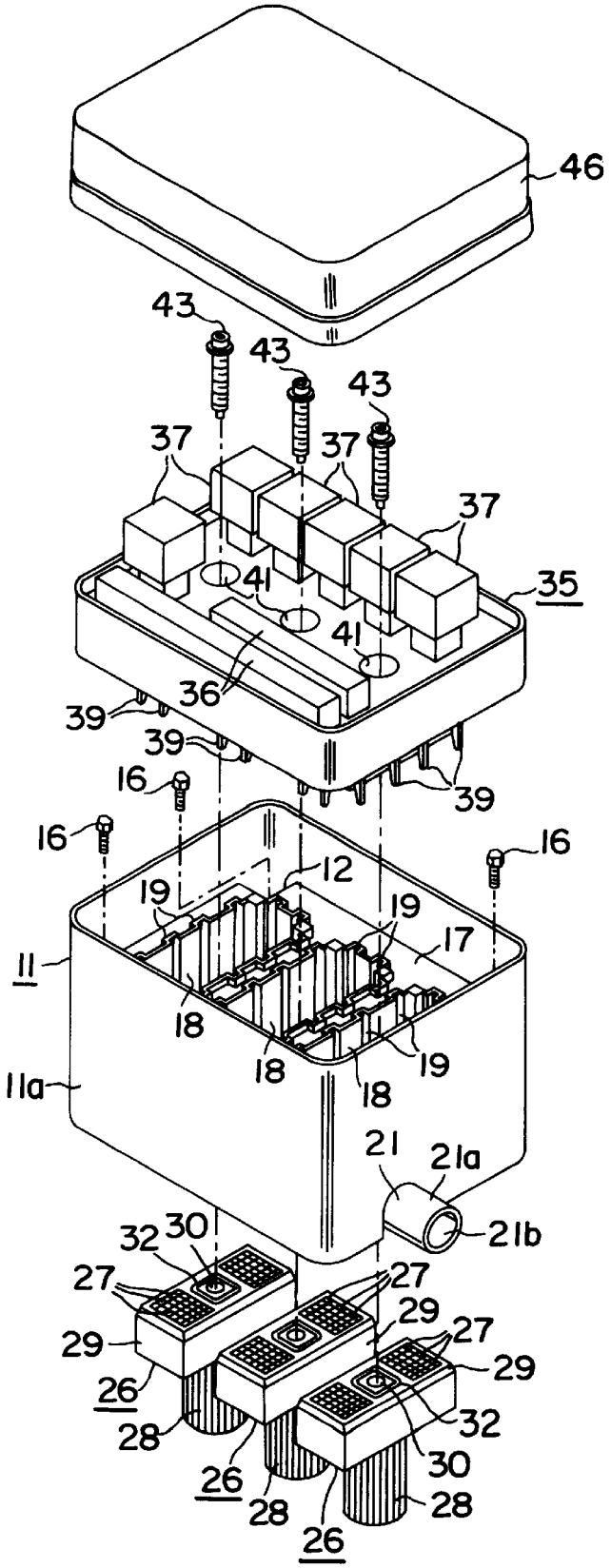
FIG. 2 is an exploded perspective view of the Invention.
Figure 3:
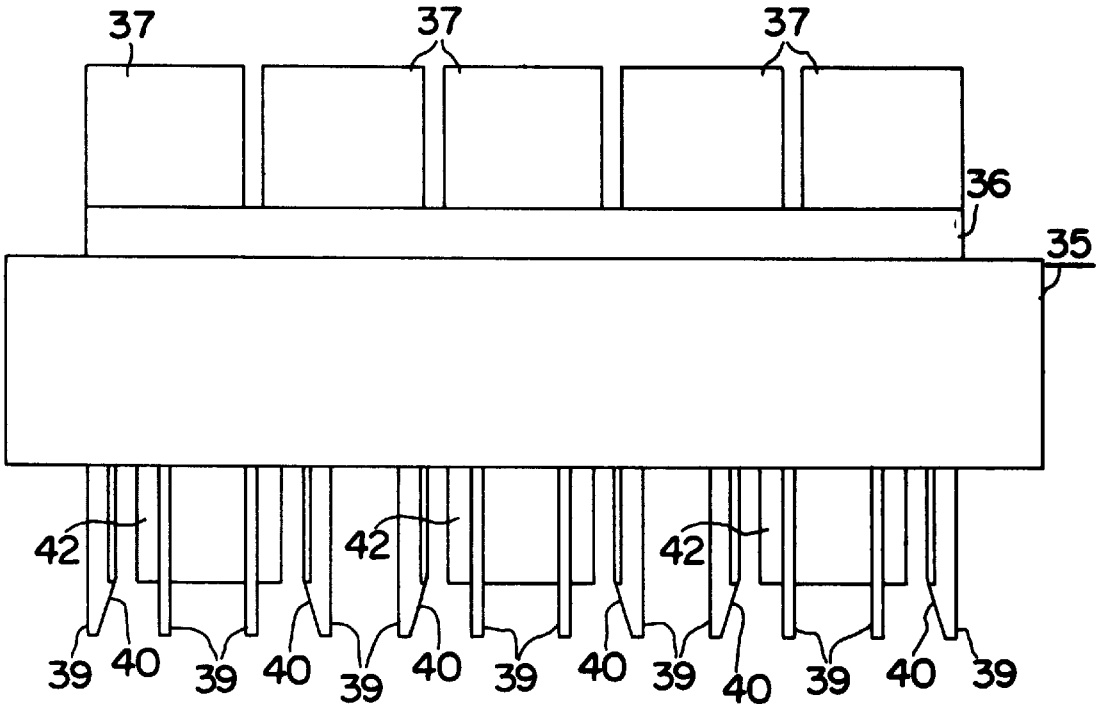
FIG. 3 is a front view of the junction block.
Figure 4:
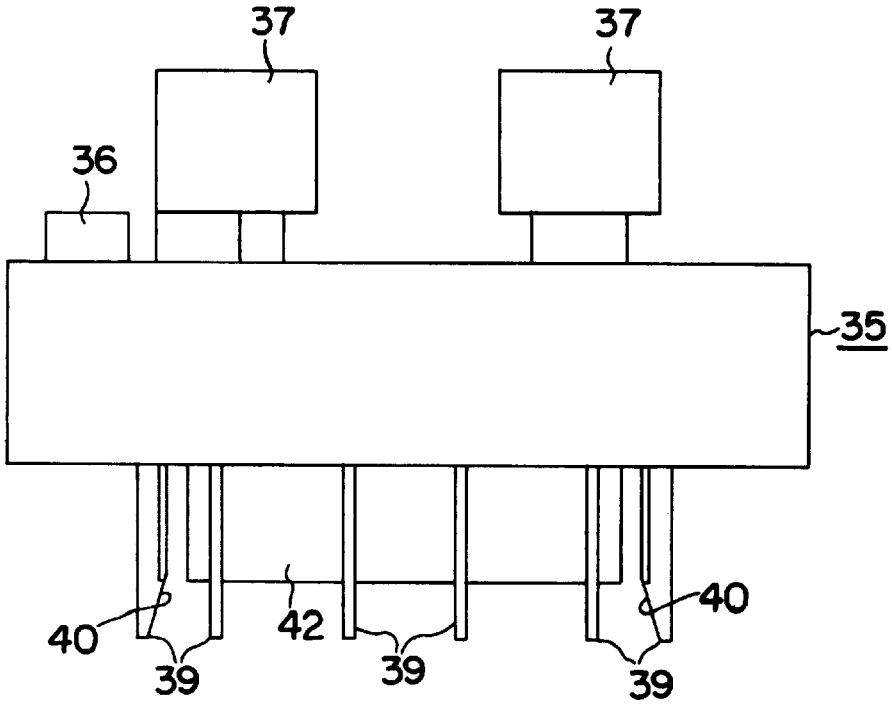
FIG. 4 is a side view of the junction block of FIG. 3.
Figure 5:
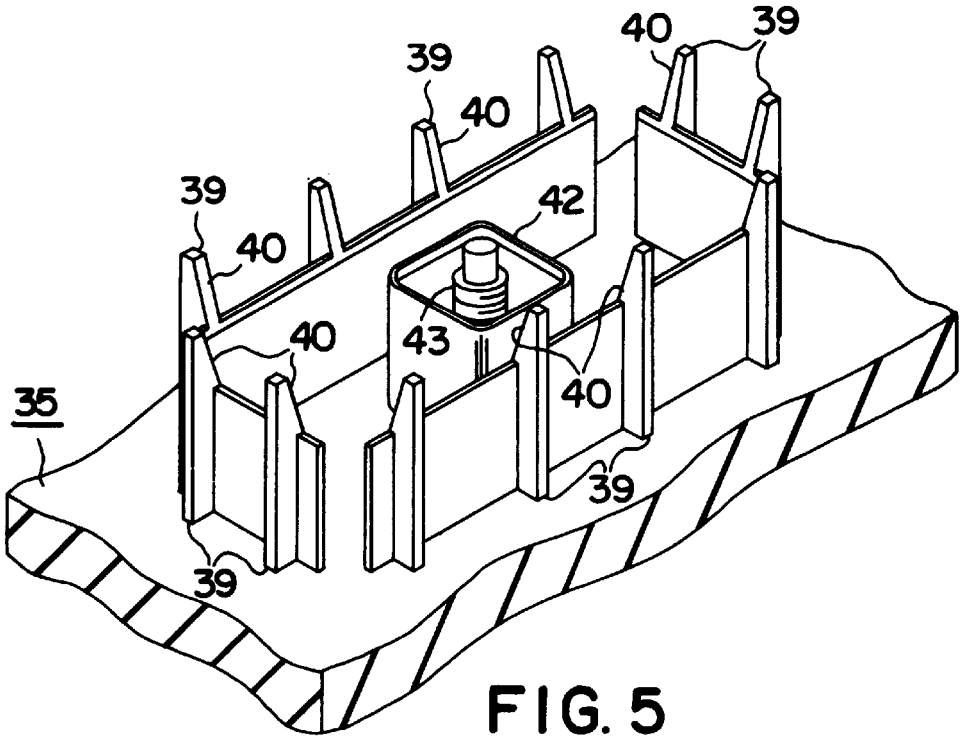
FIG. 5 is a schematic perspective view of the underside of the junction block of FIG. 3.
Figure 6:
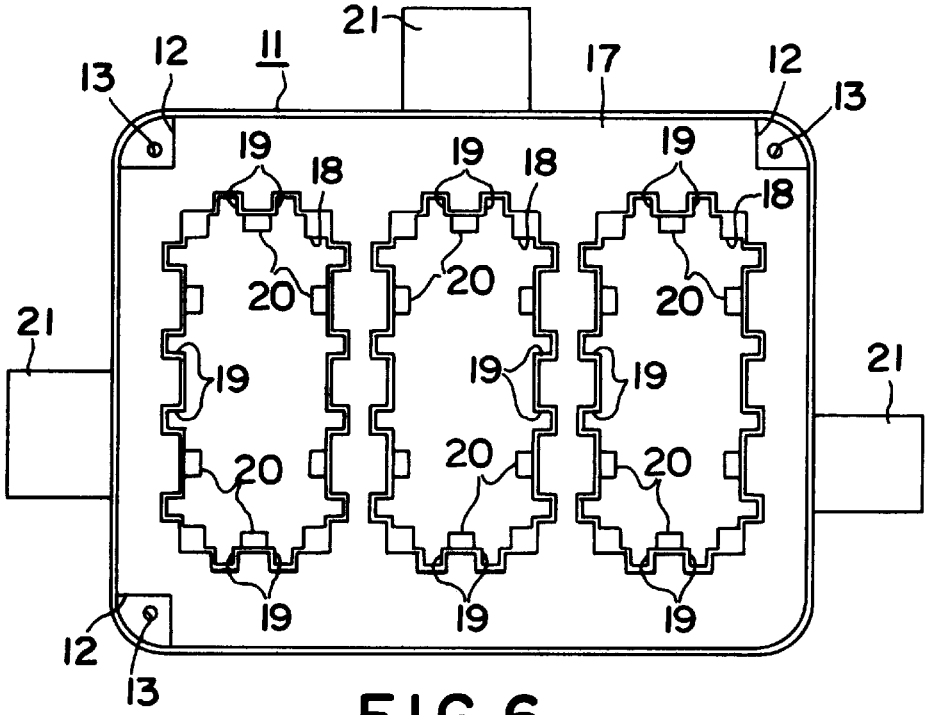
FIG. 6 is a plan view of the main box.

The inventive connection unit comprises cover 46, junction block 35 and main box 11. Junction block 35 contains, for example, fuses 36 and relays 37. It is attached to main box 11 by fastening bolts 43. Projections 39 on the underside of junction block 35 fit into cavity grooves 19 and thereby guide junction block 35 into main box 11. Connectors 26 with female contacts 27 are inserted into main box 11 from the lower end as shown in FIG. 2. Retainers 32 with insertion holes 30 are located on female contacts 27 so that fastening bolts 43, passing through bolt openings 41, engage nut 31 and secure junction block 35 to main box 11.

Figure 1:
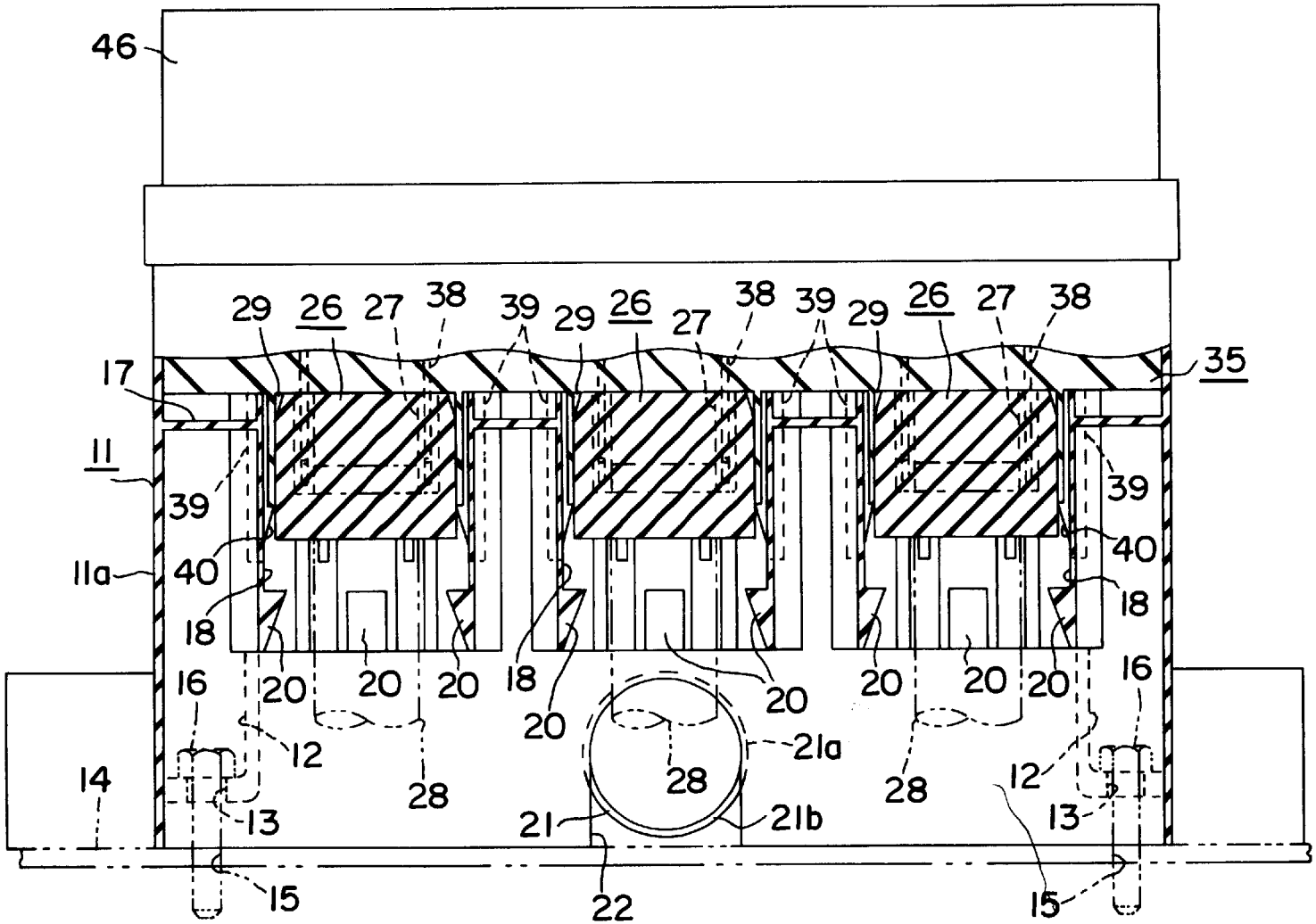
FIG. 1 is a schematic cross section of the electrical connection unit of the present Invention.

Preferably, slanted walls 11*a* extend downwardly, as shown in FIGS. 1 and 2, and bear against vehicle body 14. Securing bolts 16, passing through screw holes 15, serve to fix the electrical connection unit to the vehicle body.

Support plate 17 is at the center portion of main box 11 and connector cavities 18 are at predetermined intervals on the support plate. Claws 20 are located at the lower ends of connector cavities 18 and serve as support members. Harness opening 22 opens downward from the bottom end of side wall 11a of main box 11.

Figure 7C:
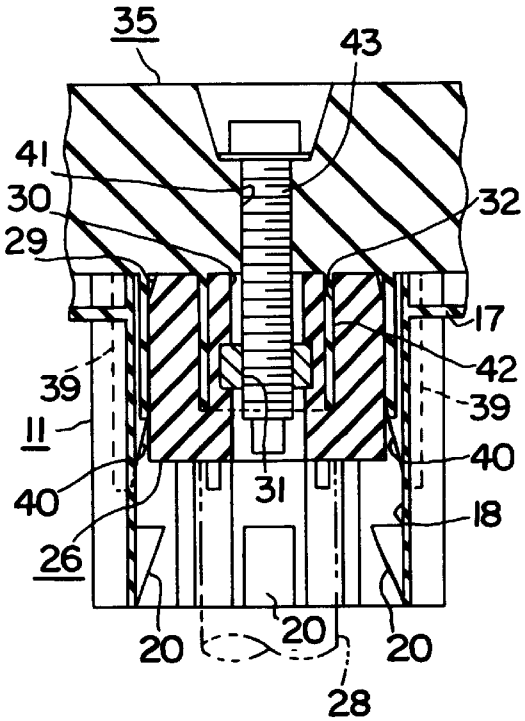
FIGS. 7 are fragmentary cross sections showing, in (*a*), (*b*) sequence, the assembly of the connection unit and (*c*) of the present Invention.
Figure 7B:
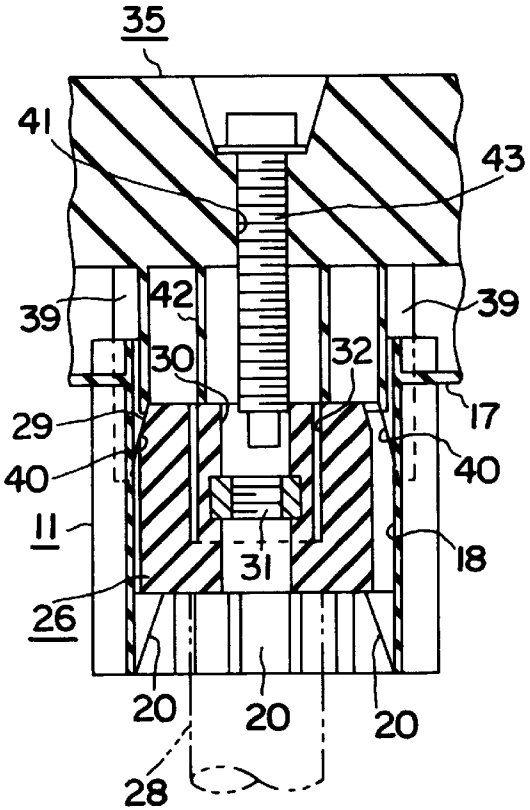
Figure 7A:
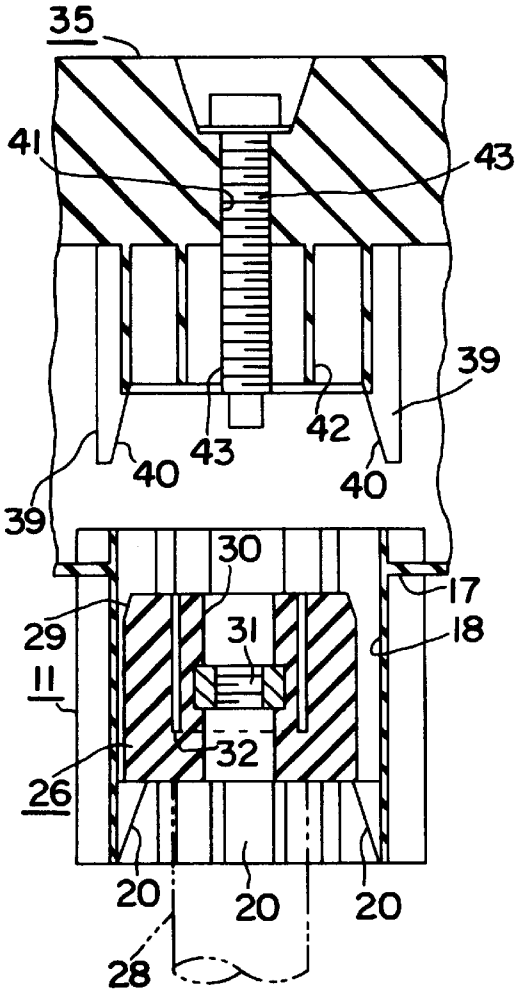

Referring more specifically to FIGS. 1, 2, and 7, connectors 26 are inserted into connector cavities 18 of main box 11 from below. They fit loosely in these cavities and are supported by claws 20 in the preliminary position as shown in FIGS. 7(*b*). Each wire harness 28 is connected to female contacts 27, extends from the lower portion of connectors 26, is passed through harness opening 22, and is secured in pull-out section 21.

Tapered surfaces 29 are on the upper outer edges of connectors 26. Insertion hole 30 is located vertically at the center of connector 26 and nut 31 is imbedded therein within retainer 32. The retainer prevents nut 31 from turning when fastening bolt 43 is inserted and tightened.

As is best shown in FIGS. 1 to 5 and 7, junction block 35 is mounted inside main box 11 from above as shown in FIG. 2. Fuses 36 and relays 37 are mounted on the upper surface of junction block 35 and a plurality of male contacts 38, connected to these electrical parts, is mounted on the lower surface. There is also provided a plurality of projections 39, in three groups in the present case, which extend from the lower surface of junction block 35 and surround male contacts 38.

When junction block 35 is mounted in main box 11, projections 39 are inserted into and engaged in cavity grooves 19 in connector cavities 18. Slanted surfaces 40, at the lower inner perimeter edge of projections 39, bear against tapered surfaces 29 as junction block 35 enters main box 11 (see particularly FIGS. 7(*b*) and (*c*)). Engagement elements 42, in the form of four-sided rings, surround bolt openings 41 in junction block 35. Bolts 43, which serve as tightening means, are inserted into bolt openings 41 and are screwed into nuts 31 within connectors 26.

As shown in FIG. 7(*c*), junction block 35 is urged against connectors 26 and male contacts 38 are firmly connected to female contacts 27 when bolts 43 are fully tightened. Elements 42 engage retainers 32 of connectors 26, thus further securing junction block 35 in its assembled position. As shown in FIGS. 1 and 2, cover 46 is placed over the upper end of main box 11.

The assembly of the electrical connection unit of the present Invention is shown in FIGS. 7(*a*), (*b*), and (*c*). In this portion of the description, reference will be made to a single connector, but it is understood that each of the plurality of connectors is assembled in the same way. Connector 26 is inserted into connector cavity 18 of main box 11 from below. Claws 20 loosely support connector 26 at a preliminary position. Wire harness 28, extending from connector 26, is passed through the harness opening.

The lower (as shown in FIG. 2) edge of side wall 11a is fixed to body 14 (see FIG. 1) of the vehicle. This is accomplished by securing bolts 16, passing through bolt hole 13 (in main box 11) and screw hole 15 (in vehicle body 14). Thereafter, as shown in FIG. 7(*b*), junction block 35 is inserted into main box 11 from above. Projections 39 are inserted into and engage cavity grooves 19 in connector cavity 18, thereby aligning junction block 35 in main box 11.

As junction block 35 is mounted, slanted surface 40 bears against tapered surface 29. As a result, connector 26, which was loosely held in connector cavity 18, is both centered and moved to the preliminary position shown in FIG. 7(*b*). Fastening bolts 43 are passed through bolt openings 41 from above and are screwed into nuts 31, as shown in FIG. 7(*c*). Engagement element 42 engages retainer 32, and fastening bolt 43 is screwed into nut 32 of connector 26. This moves connector 26 upwardly from claws 20 and causes female contact 27 to make firm electrical contact with male contact 38. The final step is to place cover 46 over the upper surface of junction block 35. The assembly of the unit is now complete.

As a result of the present construction, connector cavities 18 are formed in main box 11 to loosely hold the connectors 26. Claws 20 are disposed inside connector cavities 18 to loosely support connectors 26. Nuts 31 and the fastening bolts 43, which serve as tightening elements, are disposed between junction block 35 and connectors 26 so that, after the main box 11 is mounted on the vehicle with the connectors 26 in the preliminary positions, junction block 35 and connectors 26 can be tightened and fixed to each other. This can be accomplished without turning over junction block 35 and without requiring tools. Thus, junction block 35 and connectors 26 can be assembled efficiently. Also, with connectors 26 loosely supported in connector cavities 18 of main box unit 11, wire harnesses 28 are extended in the predetermined direction, thus allowing easy restriction.

A plurality of cavity grooves 19 are formed in the inner perimeter surfaces of connector cavities 18. The cavity grooves 19 extend along the direction in which connectors 26 are loosely inserted. On junction block 35 is formed a plurality of projections 39 that engage cavity grooves 19. Thus, when junction block 35 is mounted in main box 11, the engagement between cavity grooves 19 and projections 39 allows easy alignment of junction block 35 and connectors 26. A simple structure involving bolts 43 and nuts 31 provides reliable tightening between junction block 35 and connectors 26. The plurality of support claws 20 projecting into connector cavities 15 provides a simple structure which supports connectors 26 which are thus reliably engaged and supported at the preliminary position.

Nuts 31 are embedded in connectors 26. Fastening bolts 43 are screwed to nuts 31 via junction block 35. After junction block 35 is mounted in main box unit 11 installed in the vehicle, fastening bolts 43 are screwed into nuts 31 from above junction block 35. This allows junction block 35 and connectors 26 to be easily tightened and fixed to each other.

Although only a limited number of embodiments of the present Invention have been expressly disclosed in detail, such modifications as would be apparent to the person of ordinary skill may be made without departing from the scope or spirit thereof. For example, instead of embedding the nuts in connectors 26, they are engaged and supported thereby. Junction block 35 and connectors 26 can be tightened using means other than bolts 43 and nuts 31. Connectors 26 can be loosely held in connector cavities 18 of main box 11 using support members other than support claws 20. Cavity grooves 19 formed on connector cavities 18 and projections 39 formed on junction block 35 can be eliminated.

Nut 31 is fixed to connector 26, and bolt opening 41 is formed on junction block 35. Junction block 35 and connector 26 are tightened and fixed to each other by passing fastening bolt 43 through bolt opening 41 from above junction block 35 and screwing fastening bolt 43 to nut 31. Thus, junction block 35 and connector 26 can be easily tightened and fixed to each other using fastening bolt 43 and nut 31 without turning over junction block 35 and without obstruction from wire harness 28 extending from connector 26. This allows junction block 35 and connector 26 to be assembled more efficiently and prevents wire harness 28 from being damaged.

An engagement cavity and engagement projection 42 are disposed between junction block 35 and connector 26 and are mutually engageable to limit the position at which junction block 35 and connector 26 connect. Thus, when junction block 35 and connector 26 are assembled, the operation can be performed easily without the need to align them. The limiting means is formed from engagement element 42 and retainers 32. Engagement element 42 is formed on junction block 35 and retainer 32 is formed on connector 26. Because the limiting means has a simple structure, junction block 35 and connector 26 can be reliably positioned as desired. The engagement element 42 and retainer 32 form a ring surrounding the bolt opening and nut 31. This provides further reliability in the positioning of junction block 35 and connector 26, and improves the efficiency of assembly.

A support (claws 20) is on main box 11 so that, when connectors 26 are being installed, they are supported at the preliminary position. A locating device is disposed between connectors 26 and junction block 35 to center connectors 26 as they go from the preliminary position to the assembled position during installation in the junction block 35. Thus, there is no need to provide a centering adjuster containing a spring, allowing the structure to be simplified and the production costs to be reduced. Also, by installing junction block 35 after connectors 26 are installed in main box 11, connectors 26 can be automatically centered as they go from the preliminary position to the assembled position.

Although only a limited number of specific modifications of the present Invention have been expressly disclosed, such changes as would be apparent to the person of ordinary skill may be made without departing from the scope or spirit thereof. For example, it is not always necessary to provide the main box; the junction block may be so designed that the connectors are mounted directly therein, thus eliminating the main box entirely. In assembling the device, it is not necessary that the main box be affixed to the vehicle body before the junction block is inserted. On the contrary, it is feasible to connect the junction block and the main box first, and then secure the whole to the vehicle.

Although only a single embodiment of the present Invention has been disclosed in detail, the Invention is, nonetheless, to be broadly construed, and not to be limited except by the character of the claims appended hereto.

What we claim is:

1. An electrical connection unit comprising a main box, a plurality of connectors mounted in said main box from a first side in a first insertion direction, and a junction block carrying electrical parts, said junction block mounted in said main box from a second side opposite said first side in a second insertion direction, a plurality of connector cavities, in said main box, each one of said cavities loosely holding one of said connectors, a support in each one of said connector cavities loosely supporting one of said connectors therein when one of said connectors are mounted in a preliminary position therein, such that each one of said connectors can move in said connector cavities independent of other connectors in other connector cavities, a plurality of male tightening elements on said junction block and a plurality of female tightening elements complementary to said male tightening elements and one of each of said female tightening elements secured in an insertion hole in each of said connectors, a plurality of projections on said junction block extending beyond each of said male tightening elements in said second direction, a plurality of cavity grooves in said main box and complementary to said projections;

whereby, after said main box containing said connectors in said preliminary position is mounted on a vehicle, actuation of each of said male tightening elements and/or said female tightening elements draw said junction block and said connector toward each other into an assembled position wherein said junction block and said connectors are fixed to each other, leading portions of said projections being tapered in said second direction and entering said cavity grooves before said male tightening elements enter said insertion hole, thereby aligning said male tightening elements with said hole in said second direction and guiding said male tightening elements into said hole.

2. The connection unit of claim 1 wherein said male tightening elements on said junction block are fastening bolts and said female tightening elements are nuts on said connectors.

3. The connection unit of claim 1, wherein said support includes a claw projecting inwardly from an inner wall of said connector cavities, said connectors resting on said claw when said connectors and said junction block are in said preliminary position.

4. The connection unit of claim 1 wherein a wire harness extends from each of said connectors to a lower portion of said junction block, a nut fixed to each of said connectors, a plurality of bolt openings on said junction block, a fastening bolt passing through each of said bolt openings and screwing into said nut, whereby said connectors and said junction block are tightened and fixed to each other.

* * * * *